US005572227A

United States Patent [19]

Pal et al.

[11] Patent Number: 5,572,227

[45] Date of Patent: Nov. 5, 1996

[54] MULTIBAND ANTENNA SYSTEM FOR OPERATING AT L-BAND, S-BAND AND UHF-BAND

[75] Inventors: Surendra Pal; Vodralli K. Lakshmeesha; Vaidyanathan Mahadevan; Lourdnathan Nicholas; Kunhambu Sadanandan; Subramaniam Aswathnarayan; Manickam Kumar; Mallavalli L. Subramanya; Venkatagiri Subrahmanya; Changantidurga V. Subramanyam; Thammaiahappa Mallikarjunaiah, all of Bangalore, Ind.

[73] Assignee: Indian Space Research Organisation, Bangalore, Ind.

[21] Appl. No.: 378,172

[22] Filed: Jan. 25, 1995

[51] Int. Cl.[6] ..... H01Q 1/36; H01Q 21/28

[52] U.S. Cl. ..... 343/727; 343/895

[58] Field of Search ..... 343/725–728, 343/807, 895, 858; H01Q 21/28, 21/30, 1/36

[56] References Cited

U.S. PATENT DOCUMENTS

| | | | |
|---|---|---|---|
| 4,008,479 | 2/1977 | Smith | 343/895 |
| 4,011,567 | 3/1977 | Ben-Dov | 343/895 |
| 4,302,760 | 11/1981 | Laufer | 343/715 |
| 5,138,331 | 8/1992 | Josypenko | 343/895 |
| 5,255,005 | 10/1993 | Terret et al. | 343/895 |
| 5,343,173 | 8/1994 | Balodis et al. | 343/895 |

FOREIGN PATENT DOCUMENTS

| | | |
|---|---|---|
| 0427654 | 11/1990 | European Pat. Off. . |
| 2570546 | 9/1984 | France . |
| 2667988 | 10/1990 | France . |
| 3017169 | 5/1979 | Germany . |

OTHER PUBLICATIONS

Patent Abstracts of Japan, JP4134906, vol. 16, No. 403, (E–1254), 26 Aug. 1992.

*Primary Examiner*—Michael C. Wimer
*Attorney, Agent, or Firm*—Ladas & Parry

[57] ABSTRACT

A multiband antenna system for operating at L-band, S-band and UHF-band. The antenna includes L-band antenna elements and S-band antenna elements provided in the form of quadrifilar helices spaced from each other on the surface of a hollow cylindrical insulator. UHF band antenna elements are provided in the form of a cage dipole on the surface of the hollow cylindrical insulator. The L-band antenna input is connected to a first connector through an L-band feed network card. The S-band antenna input is connected to a second connector through an S-band feed network card and the UHF-band antenna input is connected to a third connector through a split sheath balun provided along the axis of the hollow cylindrical insulator.

3 Claims, 3 Drawing Sheets

MULTIBAND ANTENNA SYSTEM FOR OPERATING AT L-BAND, S-BAND AND UHF-BAND

The invention relates to a multiband antenna system for operating at L-band, S-band and UHF band. It is very useful in personal communication hand held sets for satellite for cellular phone system.

The antenna system according to the invention makes it possible to construct a composite antenna with relatively small dimensions. It is possible to construct the multiband antenna system according to the invention with dimensions within 10 mm diameter and 180 mm length. The antenna elements of L-band and S-band are quadrifilar helices fed in equal amplitude and quadrature phase to obtain an almost hemispherical coverage. The feed network of the antenna system is specially designed to achieve optimum results. The necessary amplitude and phase are obtained without the use of any external hybrid. The antenna element of UHF-band is a cage dipole providing a toroidal pattern.

The entire antenna system is light and is preferably enclosed in a radome. Standard interface connections such as SMA connectors are used for interface connections.

Thus the invention provides a multiband antenna system for operating at L-band, S-band and UHF-band comprising L-band antenna elements and S-band antenna elements provided in the form of quadrifilar helices spaced from each other on the surface of a hollow cylindrical insulator; UHF-band antenna elements provided in the form of a cage dipole on the surface of the said hollow cylindrical insulator; the L-band antenna input being connected to a first connector through an L-band feed network card; the S-band antenna input being connected to a second connector through an S-band feed network card and the UHF-band antenna input being connected to a third connector through a split sheath balun provided along the axis of the said hollow cylindrical insulator.

The multiband antenna system according to the invention will now be explained further with reference to the accompanying drawings in which FIG. 1 shows the multiband antenna system according to the invention.

Figure 1:
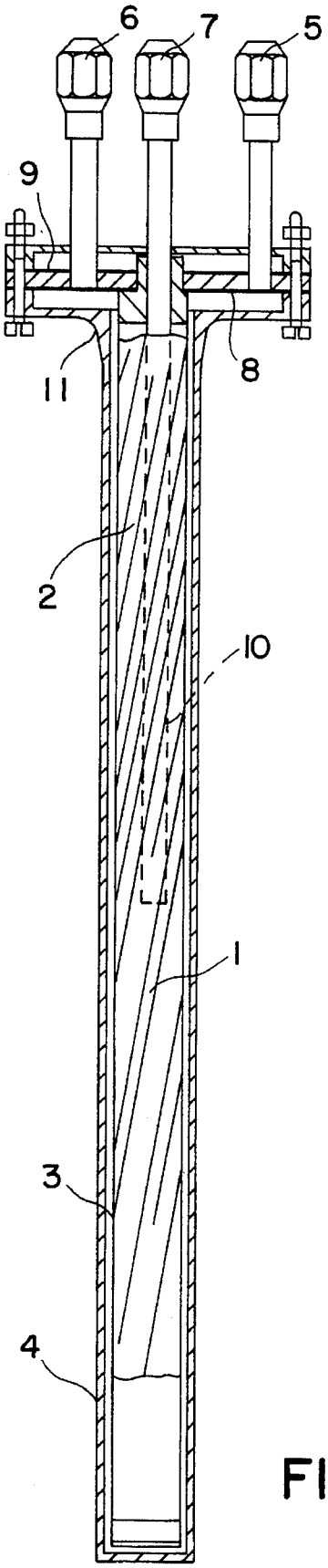
Figure 2:
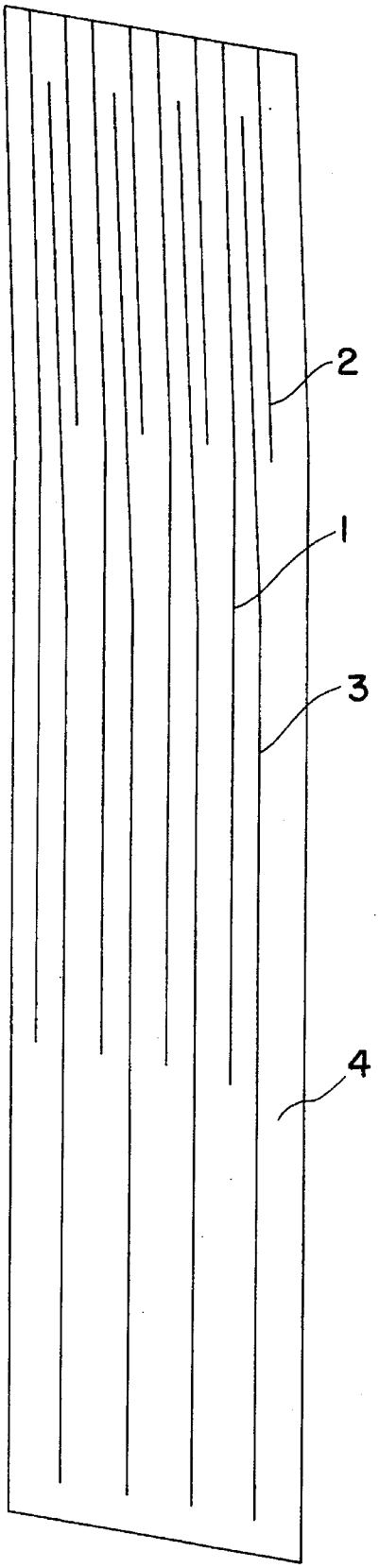
FIG. 2 shows the antenna elements spread on a flat insulator which is made into a hollow cylindrical insulator with antenna elements in quadrifilar helices.
Figure 3:
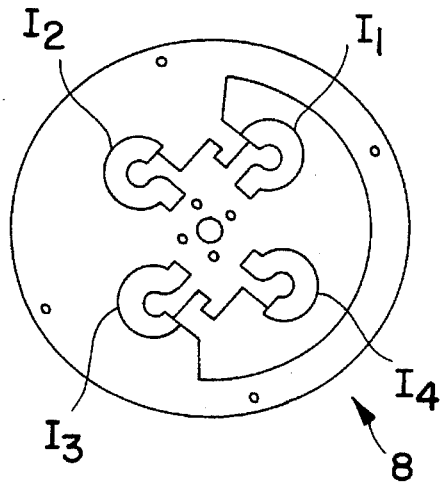
FIG. 3 shows the L-band feed network card used according to the invention.
Figure 4:
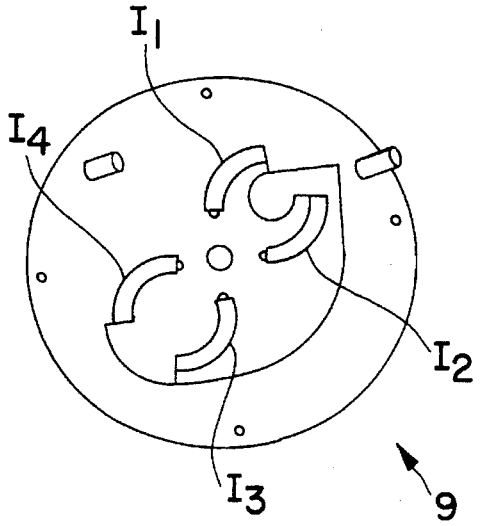
FIG. 4 shows the S-band feed network card used according to the invention.

The L-band antenna elements (1), the S-band antenna elements (2) and the UHF antenna elements (3) are provided on an insulator sheet such as KAPTON (trademark) material by photo etching. Then it is rolled into a hollow cylindrical insulator (4) forming quadrifilar helices of L-band and S-band antenna elements and a caged dipole of UHF-band antenna elements. The L-band antenna input is connected to a first connector (5) through an L-band feed network card (8). The S-band antenna input is connected to a second connector (6) through an S-band feed network card (9). The L-band and S-band network cards are shown in FIGS. 3 and 4 respectively, each network card having an input network feed line $I_1$, $I_2$, $I_3$ and $I_4$ for the respective four antenna elements of its frequency band. The UHF-antenna input is connected to a third connector (7) through a split sheath balun (10) located along the axis of the said hollow cylindrical insulator (4).

The L-band and S-band antenna elements (1,2) are terminated on the respective feed network card (8,9). The feeding terminals of the feed network card are connected to connectors (5,6) through cables preferably semi rigid cables. The split sheath balun is also connected to connector (7) for feeding UHF signals. The entire antenna assembly is preferably enclosed in a radome (11). The multiband antenna system developed is a total new development in dimensions of 10 mm diameter, for the frequencies given with a unique feed network for L,S multifilar radiators.

In a preferred embodiment of the antenna the L&S-band radiation coverage is almost hemispherical, circularly polarized with axial ratio ≈2 dB and peak gain 2.8 dB±0.2 dB, return loss better than 15 dB over ±15 MHz band. The antenna does not require a separate ground plane. The dipole radiation pattern is toroidal in shape with linear polarization and a peak gain of 2 dBi.

Figure 5:
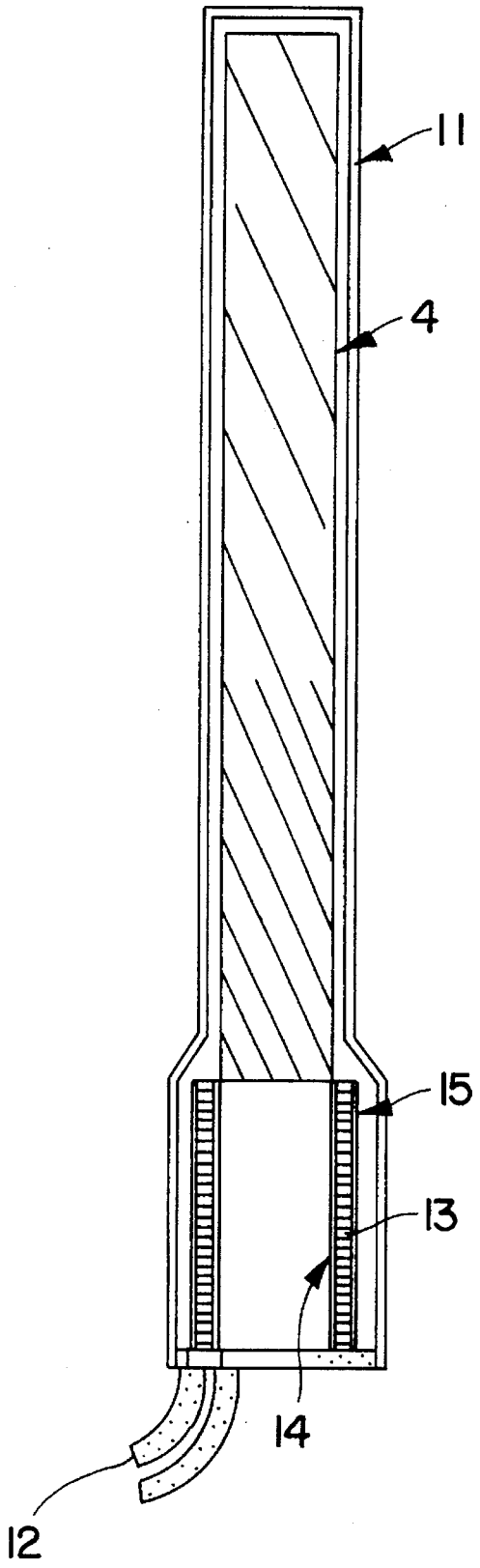
FIG. 5 shows the antenna with cylindrical feed network.

A preferred embodiment of the antenna according to the invention comprises a feed network having a cylindrical form as close in a diameter as possible to the actual antenna structure as shown in FIG. 5. This network is a vertical feed network system. The feed networks (14,15) required for the up-link frequencies and down-link frequencies are made out of a thin substrate and wrapped over the interior and exterior of a hollow cylindrical brass adaptor (13) respectively. The final connections are taken out using a coaxial flexible cable (12) with suitable connector. Depending upon the frequency of use and the type of pattern desired, the length of the antenna may be varied with a maximum of around 150 mm. The diameter of the antenna remain as 10 mm. Provision for sliding the antenna into a handset is also provided.

One of the main applications of this antenna system is in personal hand held set for LEO/ICO/GEO satellite communication. They are also very useful as space craft TTC antennas and for beacon application. They can also be used very effectively in buoys, ship terminals, cellular radio telephones, walkie-talkies etc.

Using the same technique antenna for L-band and S-band can be separately produced or a combined L,S without UHF can be also produced. The length gets reduced in the range of 90 mm to 135 mm depending upon frequency and helix geometry in the same diameter of 10 mm. By frequency scaling the antenna can be produced for other frequencies also.

We claim:

1. A multiband antenna system for operating at L-band, S-band and UHF-band comprising L-band antenna elements and S-band antenna elements provided in the form of quadrifilar helices spaced from each other on the surface of a hollow cylindrical insulator; UHF band antenna elements provided in the form of a cage dipole on the surface of the said hollow cylindrical insulator; art L-band antenna input being connected to a first connector through an L-band feed network card; art S-band antenna input being connected to a second connector through an S-band feed network card and a UHF-band antenna input being connected to a third connector through a split sheath balun provided along the longitudinal axis of said hollow cylindrical insulator.

2. The multiband antenna system as claimed in claim 1, wherein said antenna elements and said feed networks are enclosed in a radome.

3. The multiband antenna system as claimed in claim 1, wherein the L-band, S-band and UHF-band antenna inputs are connected to first, second and third connectors respectively by means of semi rigid coaxial cables.

* * * * *